United States Patent [19]

Lelental

[11] 3,935,013

[45] Jan. 27, 1976

[54] ELECTROLESS DEPOSITION OF A COPPER-NICKEL ALLOY ON AN IMAGEWISE PATTERN OF PHYSICALLY DEVELOPABLE METAL NUCLEI

[75] Inventor: Mark Lelental, Penfield, N.Y.

[73] Assignee: Eastman Kodak Company, Rochester, N.Y.

[22] Filed: Nov. 12, 1973

[21] Appl. No.: 415,459

[52] U.S. Cl. ..... 96/48 PD; 96/50 R; 96/60 R; 96/66 R; 106/1; 427/304; 427/437

[51] Int. Cl.[2] ..... G03C 5/24

[58] Field of Search.... 96/48 PD, 50 R, 66 R, 60 R; 106/1; 117/212, 130 E; 427/304, 305, 437, 438

[56] References Cited

UNITED STATES PATENTS

| | | | |
|---|---|---|---|
| 3,598,587 | 8/1971 | Yudelson et al. | 96/48 PD |
| 3,687,668 | 8/1972 | Sullivan | 96/48 PD |
| 3,719,490 | 3/1973 | Yudelson et al. | 96/48 PD |
| 3,719,508 | 3/1973 | Gulla et al. | 106/1 |
| 3,726,707 | 4/1973 | Prossey et al. | 106/1 |
| 3,822,127 | 7/1974 | Tsuboi et al. | 96/48 PD |

*Primary Examiner*—Won H. Louie, Jr.
*Attorney, Agent, or Firm*—A. H. Rosenstein

[57] ABSTRACT

A physical developer composition for latent images comprises a mixture of at least one copper salt and at least one nickel salt and a reducing agent for copper and nickel salts wherein the nickel and copper salts are in such proportions that upon reduction to a metal alloy, the alloy contains from 9 to 98 mole percent copper and from 2 to 91 mole percent nickel.

19 Claims, No Drawings

ELECTROLESS DEPOSITION OF A COPPER-NICKEL ALLOY ON AN IMAGEWISE PATTERN OF PHYSICALLY DEVELOPABLE METAL NUCLEI

This invention relates to photographic physical developers and more particularly, to a physical developer comprising a mixture of copper and nickel salts for developing a variety of latent images.

Physical development typically includes the intensification or development of a latent image by treating the latent image with a developer solution which contains a reducible metal compound and a reducing agent. In physical development, virtually all the metal in the resultant visual image is formed by the selective reduction of metal ions supplied by the reducible metal compound in the developer solution. It is desirable that the physical developer solution be so formulated that it is stable under conditions of storage, but that in the presence of a catalyst, such as the latent image, it decomposes and deposits reduced metal on the catalytic sites. Once a catalytic site is enveloped with metal deposited from the developer solution, it is essential that the reduced metal be autocatalytic, that is, it, too, must catalyze the decomposition of the physical developer solution.

A wide variety of metal ions have been incorporated in photosensitive compositions to be physically developed. The conventional photosensitive element contains a silver halide emulsion as the photosensitive component. In view of the high cost of such systems, recent imaging systems based on non-silver salts have been studied. Physical developers based on non-noble metals have also been proposed in order that the entire imaging system be based on non-noble metals.

U.S. Pat. No. 3,598,587, issued Aug. 10, 1971, describes several physical developer materials based on non-noble metals. Physical development baths employing noble metals such as silver, gold and platinum as well as non-noble metals such as nickel, cobalt, iron, and palladium are described in U.S. Pat. No. 3,687,668, issued Aug. 29, 1972.

The addition of lead, cadmium, mercury, tin, tellurium and iron ions to nickel physical development baths has been shown to have an adverse affect on the physical development in G. Salvago and P. L. Cavalloti, Plating, 59, (7), 665 (1972).

One problem involving both noble metal-containing developers and non-noble metal-containing developers is that of slow development rate.

Thus, faster developers, in order to cut down development time, are needed. Accordingly, it is an object of this invention to provide novel physical developers in which catalytic nuclei develop at a faster rate.

It is another object of this invention to provide novel physical developer formulations.

Still another object of this invention is to provide novel photographic physical developer formulations which have improved stability.

it is still another object of this invention to provide a novel method of developing images with reduced fog.

Yet another object of this invention is to provide novel physical developers which enable predetermined physical and chemical properties in deposits of metal alloys.

The above and other objects of this invention are accomplished by employing a mixture of at least one copper salt and at least one nickel salt and at least one reducing agent for copper salt and nickel salt as the photographic, physical developer composition. The physical developer of this invention comprises at least one nickel salt and at least one copper salt and at least one reducing agent for copper salt and nickel salt; said copper salt and nickel salt being in such proportions that upon reduction to a metal alloy, the alloy contains from 9 to 98 mole percent copper and from 2 to 91 mole percent nickel.

The physical developer of the invention containing both nickel and copper ions in the above molar relationship provides a physical developer with which physically developable nuclei develop at a rate appreciably faster than that obtainable from analogous developers containing only copper salts or only nickel salts or mixtures of both in ranges outside the range delineated above.

The copper salts useful herein include any water-soluble copper salt such as copper halide, such as copper chloride, copper iodide, copper bromide and the like, as well as copper sulfate, copper nitrate, copper formate and the like.

Nickel salts which are useful herein include any water-soluble nickel salt such as nickel halides, such as nickel chloride, nickel iodide, nickel bromide and the like, as well as nickel sulfate, nickel nitrate and nickel salts of organic acids such as nickel acetate, nickel formate and the like. In the preferred embodiment, nickel chloride and copper chloride are used as the salts herein.

The proportion of nickel salt and copper salt employed must be such that upon reduction to a metal alloy, the alloy contains from 9 to 98 mole percent copper and from 2 to 91 mole percent nickel. Although the proportion of nickel salt and copper salt in the developer bath necessary to obtain the above alloys will vary depending on the nickel salt, copper salt, and reducer used, generally, the development bath should contain from 2.5 to 30 mole percent copper and from 70 to 97.5 mole percent nickel based on the total moles of photosensitive metal salts in the developer. The most preferred alloy contains from 20 to 60 mole percent copper and from 40 to 80 mole percent nickel which generally corresponds to the use of 10 to about 25 mole percent copper and 90 to about 75 mole percent nickel in the developer bath.

A further advantage of the mixed copper and nickel salt developers of this invention is that a blend of physical properties such as resistivity, magnetic properties and reflection density can be obtained by the deposition of the alloy. Thus, the proportions of the metals in the developer bath may be tailored to provide the physical properties desired in the alloy.

If desired, other salts of heavy metals may be used in the developer bath such as salts of Group VIII metals such as cobalt and iron and salts of Group VIb metals such as chromium. It is preferred, however, that the copper and nickel salts together comprise at least 50 mole percent of the total metal salts in the developer composition.

The reducing agent for the copper and nickel salts can be any compound which provides a ready source of electrons for the reduction of the copper and nickel ions in the physical developer and which does not otherwise interfere with the development of the image. Suitable reducing agents in this invention include only those reducing agents which reduce both copper and nickel ions such as borane reducing agent, such as dimethylamine borane and others described in U.S. Pat. No. 3,650,748, hypophosphite, boronium salts, borohydride, and the like. Combinations of reducing agents can be used if desired.

The developer typically contains from about 0.001 to about 1.0 moles per liter of solution of the reducing agent and from about 0.01 to about 1.0 moles per liter of copper and nickel salts. Generally, at least 0.01 equivalent of reducing agent should be present in the solution for each equivalent of copper and nickel salts.

The developer solution, in addition to the copper and nickel salts and the reducing agent, generally contains at least one complexing agent for the copper and nickel ions. The complexing agent ties up the nickel and copper ions in unexposed areas of the photosensitive element and protects the unexposed areas from reduction by the reducing agent. This prevents fog from occurring in the non-image areas. Typical complexing agents which are useful herein include pyrophosphate, gluconic acid, ethanolamine, organic carboxylic acids, organic amines, ammonium, and the like.

Useful carboxylic acids include monoalkanecarboxylic acids of from 1 to 10 carbon atoms such as acetic, propionic, trimethylacetic, caproic, caprylic, and decanoic acids; dicarboxylic acids of from 2 to 8 carbon atoms such as oxalic acid, malonic, succinic, glutaric, adipic, pimelic, and suberic acids; halogenated carboxylic acids such as chloroacetic, bromoacetic, chloropropionic and bromopropionic acids; and hydroxycarboxylic acids such as lactic and tartaric acids.

Amines that are useful as complexing agents according to this invention typically include (1) monoamines including compounds having the formula $RNH_2$, wherein R is alkyl from 1 to 12 carbon atoms such as methyl, ethyl, propyl, octyl and decyl, cycloalkyl, such as cyclohexyl and cyclopentyl, and aralkyl, such as benzyl and phenethyl and compounds having the formula $R'NHR^2$, wherein each of R' and$R^2$ is independently selected from the group consisting of alkyl from 1 to 10 carbon atoms, such as methyl, ethyl, butyl, octyl, and the like, cycloalkyl, such as cyclohexyl, and aralkyl, such as phenethyl and compounds having the formula

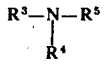

wherein each of $R^3$, $R^4$ and $R^5$ is independently selected from the group consisting of alkyl from 1 to 8 carbon atoms, such as methyl, ethyl, octyl, and the like, cycloalkyl, such as cyclohexyl, and aralkyl, such as phenethyl; (2) alkylenediamines wherein the alkylene group contains 1 to 8 carbon atoms, such as ethylenediamine and the like; (3) triamines, including diethylenetriamine, and 3,3'-diaminodipropylamine; and (4) aromatic amines such as p-aminophenol.

The proportions of the complexing agent used herein can vary over a wide range. Typically, the complexing agent is present in amounts of from 0.01 to about 10 moles per liter of developer solution. Concentrations of 0.01 to 1.0 moles per litere are preferred.

In addition, there can be added to the physical developer solutions of the invention a variety of other materials typically employed in physical developers to facilitate maintenance and operation of the developer and to improve the quality of the developed image, such as stabilizing agents, surfactants, antifoggants, buffers, thickening agents, brightening agents and the like.

Physical developers, including physical developer solutions, of this invention can be prepared merely by mixing the various components. The components can be mixed in the dry state, and then water can be added when the developer solution is desired for use. Alternatively, because of the stability of these developer solutions, the various components can be added to water prior to the time the developer solution is to be used. Although different orders of addition of the components can be employed in preparing the developers of the invention, it is preferred that the reducible copper and nickel salts and the complexing agent therefor be present in solution before the reducing agent is added.

The pH at which a physical developer solution of the invention is maintained affects both the stability of the solution itself and the quality of the image which is obtained from the physical developer solution. If the solution is moderately alkaline, i.e., if it has a pH of about 8 to about 12, the solution is more stable and image quality is improved. It is preferred to operate the developer solution at a pH of between about 8.5 and 11.0. The solution can be brought to a pH within the desired range by addition of appropriate amounts of a suitable basic material; for example, ammonium hydroxide and/or sodium hydroxide. Other useful basic materials include organic amines, for example, ethanolamine. Other bases, known to those skilled in the art, cann be substituted for these compounds. The solution can be maintained at the desired pH by incorporation therein of a suitable buffering system. A mixture of sodium carbonate and sodium bicarbonate is an example of a suitable buffering system. Other suitable buffers will be readily apparent to those skilled in the art.

As indicated above, a wide variety of photosensitive materials are useful in the process of this invention. The essential requirement which they must satisfy to be useful in this invention is that they are capable of producing physically developable nuclei, that is, nuclei which are catalytic for the reduction and deposition of metal from the physical developer solution. Metals such as palladium, silver, copper, iron, nickel, cobalt, chromium, platinum, tin, zinc, and the like are catalytic, and photosensitive elements which are capable of producing physically developable nuclei of such metals can be employed in this invention. The majority of photosensitive materials useful in the processes of this invention can be divided into three types. The first type includes those materials in which catalytic nuclei are produced directly on photoexposure. Typical of such materials are those based on such radiation-sensitive metal compounds as radiation-sensitive copper compounds in which photoexposure reduces the metal compound to physically developable nuclei of elemental metal. The second type includes those materials in which photoexposure yields a product which when reacted with a second compound, produces catalytic nuclei which are derived either from the product of photoexposure, from the second compound, or from a combination of the two. An example of this type of system is one in which photoexposed silver halide must be chemically developed and then activated to give a catalytic image. This is described, for example, in Example 3 of U.S. Pat. No. 3,650,748. The third type would include those systems in which photoexposure yields a product which is noncatalytic or can be made noncatalytic, while the unexposed material is catalytic or can be made catalytic, e.g., by chemical reaction. An example of such a system is one in which photoexposed silver halide is chemically developed to noncatalytic silver and the unexposed silver halide is reduced in the physical developer solution to catalytic silver nuclei. This is described, for example, in Example 4 of U.S. Pat. No. 3,650,748.

One photosensitive element which can be used in this invention is one based on copper (I) complexes having the formula $CuL_nX$ wherein L is a ligand selected from the group consisting of monodentate or polydentate neutral Lewis Bases containing a Group V or Group VI donor atom such as nitrogen, phosphorus, antimony, sulfur, tellurium and the like; *n* is an integer of from 1 to 4 and X is a monovalent coordinating anion such as $BH_3CN$, $NO_3$, $N_3$, Cl, Br, $BH_3CN$ and tetraphenyl boron. Such a photosensitive element is described in copending U.S. Pat. application Ser. No. 365,374 of Gysling and Vinal, filed May 30, 1973, U.S. Pat. application Ser. No. 365,375 of Gysling, filed May 30, 1973, and U.S. Pat. application Ser. No. 365,376, filed May 30, 1973.

Another photosensitive element which is useful in this invention is one containing copper (II) complexes having the formula $CuL_n[BAr_4]_2$ wherein Ar is aryl such as phenyl, n is 2 or 4 and L is a monodentate or polydentate ligand. Examples of these compounds are found in copending U.S. Pat. application Ser. No. 409,828 to Gysling, filed Oct. 26, 1973, Now U.s. Pat. No. 3,800,724.

In the practice of this invention, an exposed photosensitive element containing a latent image is contacted with a bath of a physical developer solution of this invention, for example, by immersion therein, for a period of time sufficient to produce an image of desired density. The time required to deposit a satisfactory metal image can vary from several seconds to several hours, depending upon such factors as the composition of the particular developer solution employed, the density of heavy metal image desired, the temperature of the bath, and the like. Satisfactory images can be produced from developer baths at room temperature, typically about 20°C, or at elevated temperatures, such as up to about 150°C. Increasing the bath temperature increases the rate of development, but decreases the useful life of the bath since at higher temperatures, the developer solution decomposes more rapidly. Developer bath temperatures of from about 20°C to about 60°C have been found particularly useful.

The following examples are included for a further understanding of the invention.

EXAMPLE 1

A photographic, physical developer composition was prepared by mixing a solution of 1.5 g. of dimethylamine borane in 50 ml. water with 100 ml. of a developer stock solution comprising 0.76 g. $CuCl_2.2H_2O$, 37.5 g. $NiCl_2.6H_2O$, 75 g. $Na_4P_2O_7.1OH_2O$, sufficient $NH_4OH$ to achieve a pH of 10.5 and sufficient water to achieve a final volume of 1 liter. The resulting developer comprised 2.5 mole percent copper salt based on the total moles of copper salt and nickel salt.

EXAMPLE 2

A photographic, physical developer composition was prepared by mixing a solution of 1.5 g. of dimethylamine borane in 50 ml. water with 100 ml. of a developer stock solution comprising 2.8 g. of $CuCl_2.2H_2O$, 35 g. $NiCl_2.6H_2O$, 4.8 g. citric acid, 27.3 g. ethanolamine and sufficient water to achieve a final volume of 1 liter. The resulting developer comprised 10 mole percent copper salt based on the total moles of copper salt and nickel salt.

EXAMPLE 3

A photographic, physical developer composition was prepared by mixing a solution of 1.5 g. of dimethylamine borane in 50 ml. water with 100 ml. of a developer stock solution comprising 2.8 g. $CuCl_2.2H_20$, 36 g. $NiCl_2.6H_2O$, 67 ml. of 50% gluconic acid, sufficient $NH_4OH$ to achieve a pH of 9.0 and sufficient water to achieve a final volume of 1 liter. The resulting developer comprised 10 mole percent copper salt based on the total moles of copper salt and nickel salt.

EXAMPLE 4

Various amounts of copper, including corresponding equimolar amounts of $Na_4P_2O_7.6H_2O$, were substituted for the copper in the developer solution of Example 1 and used to determine the amount of copper and nickel in the alloys formed from the compositions by developing a palladium image as follows:

A glass slide was coated with palladium nuclei by vacuum deposition. The palladium had a uniform coverage of $1.375 \times 10^{-6}$ g/cm$^2$.

The glass slides were then dipped in developer solutions containing varying proportions of copper and nickel salts. Table I shows the mole proportions of copper and nickel resulting in the alloy deposited.

TABLE I

| Copper mole % in Developer Solution | Copper mole % in Deposited Alloy | Nickel mole % in Deposited Alloy |
|---|---|---|
| 0 | 0 | 100 |
| 2.5 | 8.83 | 91.17 |
| 5.0 | 16.65 | 83.35 |
| 7.5 | 17.60 | 12.40 |
| 10.0 | 22.10 | 77.90 |
| 12.5 | 29.81 | 70.19 |
| 15.0 | 30.82 | 69.18 |
| 17.5 | 31.75 | 68.25 |
| 20.0 | 43.83 | 56.17 |
| 25.0 | 96.37 | 3.63 |
| 30.0 | 98.48 | 1.52 |
| 40.0 | 100.00 | 0 |
| 50–100 | 100.00 | 0 |

EXAMPLE 5

Various amounts of copper were substituted for the copper in the developer solution of Example 2 and used to determine the amount of coppere and nickel in the alloys formed from the compositions by developing a palladium image as follows:

A glass slide was coated with palladium nuclei by vacuum deposition. The palladium had a uniform coverage of $1.375 \times 10^{-6}$ g/cm$^2$.

The glass slides were then dipped in the developer solutions containing the varying proportions of copper and nickel salts. Table II shows the mole proportions of copper and nickel resulting in the alloy deposited.

TABLE II

| Copper mole % in Developer Solution | Copper mole % in Deposit | Nickel mole % in Deposit |
|---|---|---|
| 0 | 0 | 100 |
| 10 | 29.54 | 70.46 |
| 20 | 39.19 | 60.81 |
| 30 | 100.00 | 0 |
| 40 | 100.00 | 0 |
| 50 | 100.00 | 0 |
| 100 | 100.00 | 0 |

EXAMPLE 6

Various amounts of copper were substituted for the copper in the developer soluution of Example 3 and used to determine the amount of copper and nickel in the alloys formed from the compositions by developing a palladium image as follows:

A glass slide was coated with palladium nuclei by vacuum deposition. The palladium had a uniform coverage of $1.375 \times 10^{-6}$ g/cm$^2$.

The glass slides were then dipped in the developer solutions containing the caarying proportions of copper and nickel salts. Table III shows the mole proportions of copper and nickel resulting in the alloy deposited.

TABLE III

| Copper mole % in Developer Solution | Copper mole % in Deposit | Nickel mole % in Deposit |
|---|---|---|
| 0 | 0 | 100 |
| 10 | 29.5 | 70.5 |
| 20 | 49.4 | 50.6 |
| 30 | 76.5 | 23.5 |
| 100 | 100.0 | 0 |

EXAMPLE 7

The rate of deposition was measured for various copper-nickel developers of the composition of Example 1 and compared to copper developers alone and nickel developers alone. The results are shown in Table IV.

TABLE IV

| Copper Mole Percent in Developer Solution | Copper Mole Percent in Alloy Deposit | Rate of Development ($\mu$moles Ni+Cu/cm$^2$ min.) | Quality of Image |
|---|---|---|---|
| 0 | 0 | 0.622 | Excellent |
| 2.5 | 8.83 | 1.073 | Excellent |
| 5.0 | 16.65 | 1.239 | Excellent |
| 7.5 | 17.60 | 1.987 | Excellent |
| 10.0 | 22.10 | 2.158 | Excellent |
| 12.5 | 29.81 | 2.361 | Excellent |
| 15.0 | 30.82 | 2.381 | Excellent |
| 20.0 | 43.83 | 2.374 | Excellent |
| 30.0 | 98.48 | 0.198 | Excellent |
| 40.0 | 100.00 | 0.213 | Excellent |
| 50–100 | 100.00 | 0.210 | Excellent |

EXAMPLE 8

The rate of deposition was measured for various copper-nickel developers of the composition of Example 2 and compared to copper developers alone and nickel developers alone. The results are shown in Table V.

TABLE V

| Copper Mole Percent in Developer Solution | Copper Mole Percent in Alloy Deposit | Rate of Development ($\mu$moles Ni+Cu/cm$^2$ min.) | Quality of Image |
|---|---|---|---|
| 0 | 0 | 0.408 | Excellent |
| 10 | 29.54 | 0.879 | Excellent |
| 20 | 39.19 | 1.482 | Excellent |
| 33 | 100.00 | 0.077 | Excellent |
| 50 | 100.00 | 0.118 | Excellent |
| 100 | 100.00 | 0.387 | Excellent |

EXAMPLE 9

The rate of deposition was measured for various copper-nickel developers of the composition of Example 3 and compared to copper developers alone and nickel developers alone. The results are shown in Table VI.

TABLE VI

| Copper Mole Percent in Developer Solution | Copper Mole Percent in Alloy Deposit | Rate of Development ($\mu$moles Ni+Cu/cm$^2$ min.) | Quality of Image |
|---|---|---|---|
| 0 | 0 | 0.345 | Excellent |
| 10 | 29.5 | 0.468 | Excellent |
| 20 | 49.4 | 0.692 | Excellent |
| 30 | 76.5 | 0.549 | Excellent |
| 100 | 100.0 | 0.319 | Excellent |

EXAMPLE 10

This is a comparative example.

The developed image and rate of development of the palladium coated glass slide developed with the developers of Example 4 was compared to that of the glass slide developed with a mixed nickel cobalt developer prepared by adding varying amounts of $CoCl_2.6H_2O$ (for example, 0.42 g. of $CoCl_2.6H_2O$ is added to form a developer comprising 10 mole percent cobalt salt) to a nickel stock solution comprising 37.5 g. $NiCl_2.6H_2O$, 75 g. $Na_4P_2O_7.10H_2O$, sufficient $NH_4OH$ to achieve a pH of 10.5 and sufficient water to achieve a final volume of 1 liter. 1.5 Grams of dimethylamine borane were added. Table VII shows the various rates of development and quality of image achieved.

TABLE VII

| Cobalt mole percent in developer solution | Cobalt mole percent in alloy deposited | Rate of Development ($\mu$moles cobalt+Ni/cm$^2$ min.) | Quality of Image |
|---|---|---|---|
| 0 | 0 | 0.622 | Good |
| 10 | 20.7 | 0.525 | Poor |
| 20 | 32.6 | 0.618 | Poor |
| 30 | 40.0 | 0.640 | Poor |
| 40 | 46.7 | 0.587 | Poor |
| 50 | 59.0 | 1.961 | Poor |
| 100 | 100.0 | 1.113 | Poor |

As seen above, the quality of the developed image is poor as compared to the quality of the image of the nickel-copper developers of Example 4.

Example 11

A paper support was imbibed with 0.25 g. $CuP(OCH_3)_3BH_3CN$ in 7ml. chloroform and imagewise exposed to a 360 watt Gates lamp for 2 minutes and developed to a negative image by immersing in a physical developer prepared by mixing a solution of 1.5 g. of dimethylamine borane in 50 ml. of water with 100 ml. of a developer stock solution comprising 37.5 g. $NiCl_2.6H_2O$, 75 g. $Na_4P_2O_7.10Hh_2O$, sufficient $NH_4OH$ to achieve a pH of 10.5 and sufficient water to achieve a final volume of 1 liter and sufficient $CuCl_2.2H_2O$ so that the developer comprised 10 mole percent copper salt based on the total moles of copper salt and nickel salt.

EXAMPLE 12

A paper support was imbibed with 0.5 g. $Na_2Cu(C_2O_4)_2.\ 2H_2O$ in 50 ml. water and imagewise exposed to a 360 watt Gates lamp for 2 minutes and developed to a negative image by immersing in the physical developer described in Example 11.

The invention has been described in detail with particular reference to certain preferred embodiments thereof, but it will be understood that variations and modifications can be effected within the spirit and scope of the invention.

I claim:

1. A developed photographic element comprising a support having thereon physically developable metal nuclei in an imagewise pattern and an imagewise coating of a copper nickel alloy containing from 9 to 98 mole percent copper and from 2 to 91 percent of nickel based on total moles of copper and nickel said coating being formed by electroless deposition of said alloy onto said nuclei.

2. The element of claim 1 wherein the alloy contains from 20 to 60 mole percent copper and from 40 to 80 mole percent nickel.

3. The method of developing an image comprising contacting physically developable metal nuclei in an imagewise pattern with a photographic, physical developer composition comprising a mixture of at least one copper salt and at least one nickel salt and at least one reducing agent for copper salt and nickel salt; said copper salt and nickel salt being in such proportion that upon reduction to a metal alloy, the alloy contains from 9 to 98 mole percent copper and from 2 to 91 mole percent nickel.

4. The method of claim 3 wherein the physically developable metal nuclei in an imagewise pattern are formed by the imagewise exposure of a photosensitive material to actinic radiation.

5. The method of claim 3 wherein the reducing agent comprises hypophosphite.

6. The method of claim 3 wherein the developer composition also comprises a complexing agent.

7. The method of claim 6 wherein the complexing agent is pyrophosphate.

8. The method of claim 6 wherein the complexing agent is ammonia.

9. The method of claim 6 wherein the complexing agent is gluconic acid.

10. The method of claim 6 wherein the complexing agent is ethanolamine.

11. The method of claim 3 wherein the developer composition comprises from 2.5 to 30 mole percent of copper based on total moles of copper and nickel.

12. The method of claim 3 wherein the proportion of copper salt and nickel salt is such that upon reduction to metal alloy, the alloy contains from 20 to 60 mole percent copper and from 40 to 80 mole percent nickel.

13. The method of claim 3 wherein the developer composition comprises from about 0.001 to about 1.0 moles per liter of composition of reducing agent and from about 0.01 to about 10 moles per liter of composition of complexing agent.

14. The method of claim 17 wherein the copper salt is copper chloride.

15. The method of claim 3 wherein the nickel salt is nickel chloride.

16. The method of claim 3 wherein the development is carried out at a temperature of from 20°C to 100°C.

17. The method of claim 4 wherein the developer is contacted with the imagewise exposed photosensitive material by immersion of the photosensitive material into a bath of the developer composition.

18. The method of claim 4 wherein the photosensitive material comprises a copper (I) complex.

19. The method of claim 3 whereinn the reducing agent comprises dimethylamine borane.

* * * * *

UNITED STATES PATENT AND TRADEMARK OFFICE

CERTIFICATE OF CORRECTION

PATENT NO. : 3,935,013

DATED : January 27, 1976

INVENTOR(S) : Mary Lelental

It is certified that error appears in the above-identified patent and that said Letters Patent are hereby corrected as shown below:

Title page, under References Cited, column 2, "Prossey" should read ---Prosser---.

Column 1, line 61, "it" should read ---It---.

Column 3, line 63, "litere" should read ---liter---.

Column 5, lines 29-30, "U.S. Pat. No. 3,800,724" should read ---U.S. Pat. No. 3,880,724---.

Column 6, line 51, "coppere" should read ---copper---.

Column 7, line 19, "soluution" should read ---solution---; and, line 38, "caarying" should read ---varying---.

Column 9, line 24, "$10Hh_2O$" should read ---$10H_2O$---.

Column 10, line 44, "17" should read ---3---.

Column 10, line 56, "whereinn" should read ---wherein---.

Signed and Sealed this eighteenth Day of May 1976

[SEAL]

Attest:

RUTH C. MASON
*Attesting Officer*

C. MARSHALL DANN
*Commissioner of Patents and Trademarks*